US005738263A

United States Patent [19]

Lewis

[11] Patent Number: 5,738,263

[45] Date of Patent: Apr. 14, 1998

[54] TWO PIECE DISPOSABLE PROMOTIONAL BACK PACK AND METHOD OF FABRICATING SAME

[76] Inventor: Ann Lewis, 712 Cristy Ct., Woodstock, Ga. 30188

[21] Appl. No.: 740,866

[22] Filed: Nov. 4, 1996

Related U.S. Application Data

[63] Continuation-in-part of Ser. No. 504,248, Jul. 19, 1995, Pat. No. 5,570,828.

[51] Int. Cl.[6] ..... A45F 3/04

[52] U.S. Cl. ..... 224/627; 224/906; 224/645

[58] Field of Search ..... 224/627, 645, 224/654, 655, 906; 383/24, 66; 150/107, 127, 128

[56] References Cited

U.S. PATENT DOCUMENTS

| | | | |
|---|---|---|---|
| 1,501,134 | 7/1924 | Osburn . | |
| 3,269,637 | 8/1966 | Whittaker | 229/16 |
| 3,471,163 | 10/1969 | Swara | 280/47.26 |
| 3,998,304 | 12/1976 | Edgerton, Jr. et al. | 190/48 |
| 4,054,166 | 10/1977 | Burke | 150/52 R |
| 4,318,505 | 3/1982 | Cordell, Jr. | 229/52 B |
| 4,423,834 | 1/1984 | Rush | 224/151 |
| 4,609,084 | 9/1986 | Thomas | 190/110 |
| 4,778,090 | 10/1988 | Facchina | 224/153 |
| 5,090,526 | 2/1992 | Jacober | 190/107 |
| 5,255,834 | 10/1993 | Bendersky | 224/209 |
| 5,346,308 | 9/1994 | Buhot et al. | 383/4 |
| 5,377,887 | 1/1995 | Garcia | 224/153 |
| 5,570,828 | 11/1996 | Lewis | 224/627 |

*Primary Examiner*—David J. Walczak
*Attorney, Agent, or Firm*—Isaf, Vaughan & Kerr

[57] ABSTRACT

A disposable plastic back pack is formed from a thin sheet of plastics material. The sheet has a generally rectangular body portion that has a top edge, a bottom edge, and ends, and an elongated tail portion divided into two sections. The disposable back pack also includes a second sheet of thin plastic material that is generally rectangular in shape. The body portion is folded over onto itself at its ends forming a longitudinal flap extending from the top edge to the bottom edge, and the tail sections are folded over the folded body portion so that the distal ends of the tail sections are aligned with the top edge of the body portion. The second sheet of plastics material is then placed adjacent to and aligned with the unfolded side of the body portion of the first sheet of plastics material. The entire periphery of the back pack thus configured is then heat sealed so that the folded body portion forms a pouch, the folded tail sections form shoulder straps to support the pouch on a wearer's back, and the second sheet of plastics material forms an upwardly open pocket on the side of the pouch opposite the shoulder straps for displaying advertisements and other promotional indicia. The pouch also serves as a storage compartment so that a wearer can carry items while keeping both hands free to perform other tasks.

14 Claims, 3 Drawing Sheets

TWO PIECE DISPOSABLE PROMOTIONAL BACK PACK AND METHOD OF FABRICATING SAME

CROSS REFERENCE TO RELATED APPLICATIONS

This is a continuation-in-part of application Ser. No. 08/504,248 filed Jul. 19, 1995, now U.S. Pat. No. 5,570,828.

TECHNICAL FIELD

This invention relates generally to containers for carrying items and more particularly to a disposable plastic container having shoulder straps to allow the container to be worn as a back pack.

BACKGROUND OF THE INVENTION

Attendees at tradeshows, trade conventions, and similar events tend to collect a substantial amount of literature, samples, and other items provided by vendors displaying their goods and services at the event. To accommodate these items, some vendors, and usually the tradeshow sponsor itself, will provide simple plastic bags into which collected items can be placed for convenient carrying. Sometimes these bags are printed with the trademark or service mark of a vendor providing the bag so that the bag doubles as a medium for promotional advertisement.

While simple plastic bags are distributed by the thousands at tradeshows and serve their purpose of providing a convenient carrier for articles collected at the show, these simple bags embody certain inherent problems and shortcomings. For example, while the bags typically are used by patrons at the show itself, they usually are simply discarded immediately after the show when the materials carried therein are taken out and filed. In addition, any vendor advertisements that may be printed on the bags have a diminished impact because the bags, when carried, are positioned at approximately knee level such that advertisements printed thereon are not readily visible. This is particularly true in large crowds common at tradeshows and conventions where the mere closeness of the individuals obscures any promotional advertisements printed on hand-carried bags.

Another problem with carried plastic bags at events such as tradeshows is that they necessarily engage one hand of a user. This is particularly inconvenient since the attendees at tradeshows usually need to exchange business cards, fill out information forms, test certain displayed products at the show, and otherwise engage in activities that require use of their hands. When engaging in this activity, the plastic bag usually is either slid up the user's arm to the elbow or placed on the floor. Clearly, either alternative is inconvenient and placing the bag on the floor results in a substantial instance of lost materials.

Thus, there exists a continuing and heretofore unaddressed need for an improved container for carrying items collected at tradeshows and conventions. During normal use, the container should securely contain all the brochures and samples collected at a convention. The container should leave a user's hands free, and, during normal use, should display printed promotional advertisements at or near eye level rather than knee level so that the ads can be more effective. The container should be reusable for other purposes after the show so that the printed advertisements thereon can have continued effect. The container should also be easy to fabricate, thus it should have as few separate components as possible. Finally, the container should be made of biodegradable material so that, when disposed, it does not adversely impact the environment. It is to the provision of such a container that the present invention is primarily directed.

SUMMARY OF THE INVENTION

Briefly described, the present invention, in a preferred embodiment thereof, comprises a disposable back pack for use by attendees at conventions and tradeshows to contain promotional materials and samples collected at the show. The back pack of this invention is formed from a folded and heat sealed sheet of plastics material that, when folded, has a substantially rectangular body portion with a top edge, a bottom edge, a first end, and a second end. An elongated tail portion of the sheet extends from the bottom edge of the body portion. The tail portion can be formed with or be cut to have a longitudinal slit extending along the center of the tail portion and defining first and second adjacent tail sections. Each tail section is flared outward along its length so that the sections are wider at their free ends than at the body portion. In addition, the free ends of the tail sections are cut at respective inwardly extending angles. When the adjacent sections are in contact along the longitudinal slit, the inwardly angled distal ends of each section meet to give the tail portion a V-shaped appearance. The back pack of the present invention may also include a second sheet of plastics material smaller than the body portion of the first sheet of plastics material. This second sheet is sealed to the back pack as described below to define an independent open-roped pocket.

Several embodiments of the present invention are envisioned. In a first embodiment, the second sheet of plastics material is not used. The body portion of the first sheet of plastics material is folded over onto itself along a first fold line spaced from the first end to form a first flap and along a second fold line spaced from the second end to form a second flap. The fold lines are located so that the ends of the folded sheet substantially meet and, preferably, overlap along a line intermediate the fold lines. Together, the first and second flaps form the folded body portion and the remaining central portion of the body forms the unfolded body portion.

The first and second sections of the tail portion are then folded over the first and second flaps. As they are folded, the first and second tail sections are twisted inward a half turn toward the overlapping ends of the flaps. The inward twist serves two purposes. First, because the distal end of each tail section is inwardly angled, the inward twist aligns the distal end of each section with the top edge of the body portion. Second, the inward twist contours each tail section so that it will comfortably conform to the contours of a wearers body, as described in more detail below.

Once the distal ends of each twisted tail section are properly aligned with the top edge of the body portion and the flaps, the flaps are heat sealed along their top and bottom edges to the top and bottom edges of the body portion to form a substantially rectangular pouch with the sealed top and bottom edges forming the top and bottom of the pouch respectively and the fold lines forming the sides of the pouch. The overlapping ends of the flaps define a slot on one side of the pouch extending between the top and bottom of and providing access to the pouch.

Because the distal ends of the tail sections are in alignment with the top edge of the flaps during the heat sealing process, the distal end of each tail section is simultaneously sealed to the top edge of the pouch. As a result, each tail section forms a shoulder strap through which a wearer's arm can be inserted to support the pouch on the wearer's back. Moreover, added support is provided to the pouch due to the increased width of the distal ends of the tail sections, and the manner in which the angled distal ends are anchored to the pouch. The distal ends of the tail sections are wider than the remainder of the tail sections so that they overlap to cover the entire length of the top of the pouch once the ends are properly aligned and heat sealed. Thus, the central portion of the pouch is supported by the straps. This unique configuration prevents the central buckling that is typical of shoulder supported back packs.

When the back pack is donned by a wearer in this way, the slot providing access into the pouch is positioned against the wearer's back and the other side of the pouch faces away from the wearer. It should be noted that the sides of the pouch can be sealed in a manner similar to the top and bottom edges and distal ends of the tail sections if desired, but such sealing is not required.

In a second embodiment of the present invention, the second sheet of plastics material is used. In accordance with the first embodiment of the present invention, the body portion is folded over onto itself and the tail sections are folded so that their distal ends are aligned with the top edge of the folded body portion. However, prior to sealing the folded body portion and tail sections of the first sheet of plastics material, a second sheet of plastics material is positioned adjacent the side of the body portion opposite the flaps. The second sheet of plastics material is approximately the same width as the pouch, but is shorter by a predetermined amount. The second sheet has a bottom edge, a top edge and ends. When the bottom edge of the second sheet of plastics material is substantially aligned with the bottom edge of the pouch, and when the ends of the second sheet of plastics material are substantially aligned with the sides of the pouch, the second sheet of plastics material is sealed along its bottom edge and ends to the pouch formed by the first sheet of plastics material. Although the top and bottom edge of the unfolded body portion and flaps along with the distal ends of the tail sections are sealed together during the sealing process, the top edge of the second sheet of plastics material is not sealed because it is shorter than the pouch. Instead, it remains unsealed to provide an opening into the pocket formed between the second sheet of plastics material and the pouch created by the sealing process.

Because the second sheet of plastics material is transparent, it provides an ideal location for advertising and other promotional indicia that may be placed therein by event sponsors, food or beverage retailers, or anyone wishing to advertise their goods or services. Such advertising and other promotional indicia is simply slid into the pocket so that when the pouch is worn by a user, the printed promotional material is displayed on the back of the wearer at or just below the eye level of others. Accordingly, the promotional indicia is much more effective than it would be on a bag carried to one's side since it is easily visible and not obscured by crowds of people.

Because the second sheet of plastics material is shorter than the folded body portion of the first sheet of plastics material, the top edge of the second sheet of plastics material is aligned beneath the location where the top edge of the unfolded body portion and distal ends of the tail sections are sealed. This feature allows all of the elements to be sealed in one step, simultaneously.

Finally, the disposable back pack of the present invention is formed of inexpensive plastics material that preferably is biodegradable so that, when discarded, the entire back pack dissolves and does not adversely affect the environment.

Accordingly, it is an object of this invention to provide an improved container for carrying promotional materials, samples and other items at tradeshows and conventions.

Another object of the invention is to provide a disposable back pack that can be used to contain promotional materials, samples, and other items at tradeshows and conventions and that is worn on the back to free the hands of the wearer.

A further object of the invention is to provide a disposable plastic back pack that has a separate transparent pocket for carrying promotional indicia that is displayed at about eye level so that the advertising impact of the indicia is increased.

An additional object of the invention is to provide a container for carrying materials at tradeshows and conventions that is biodegradable so that it does not adversely impact landfills or the environment when discarded.

A still further object of the invention is to provide a disposable back pack that can be assembled from one piece of plastics material.

A still further object of the invention is to provide a disposable plastic back pack that has a separate pocket for carrying promotional indicia which can be fabricated using only two sheets of plastics material.

A still further object of the present invention is to provide a disposable plastic back pack that can be sealed in one step during fabrication.

These and other features, objects, and advantages of the invention will become more apparent upon review of the detailed description set forth below taken in conjunction with the accompanying drawings, which are briefly described as follows.

DETAILED DESCRIPTION OF THE PREFERRED EMBODIMENTS

Figure 1:
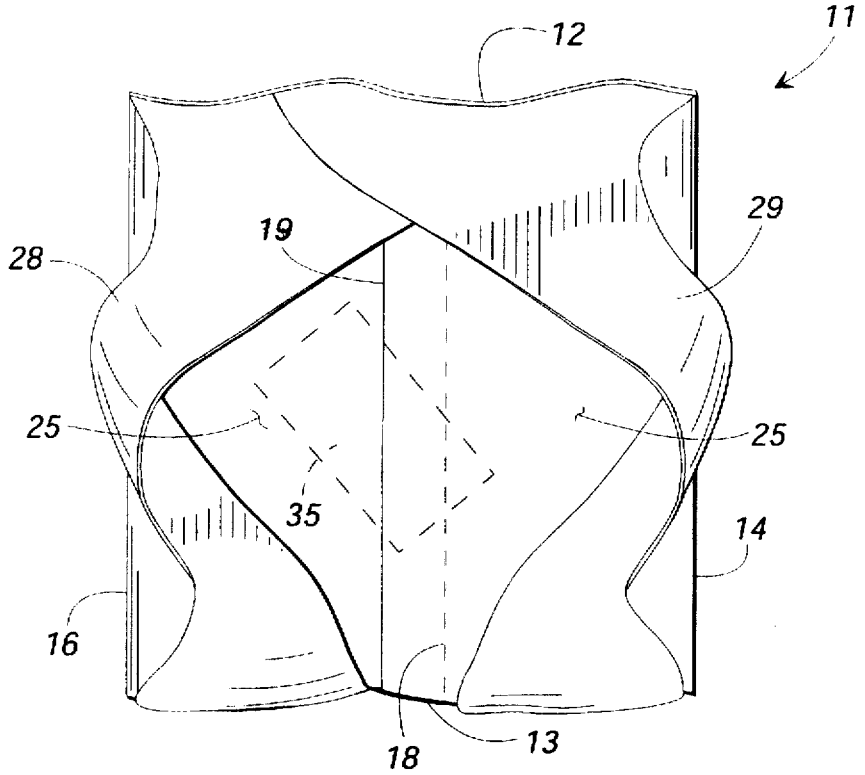
FIG. 1 is an elevational view of the back pack of this invention showing the side of the back pack that rests against a wearer's back when the back pack is in use.
Figure 2:
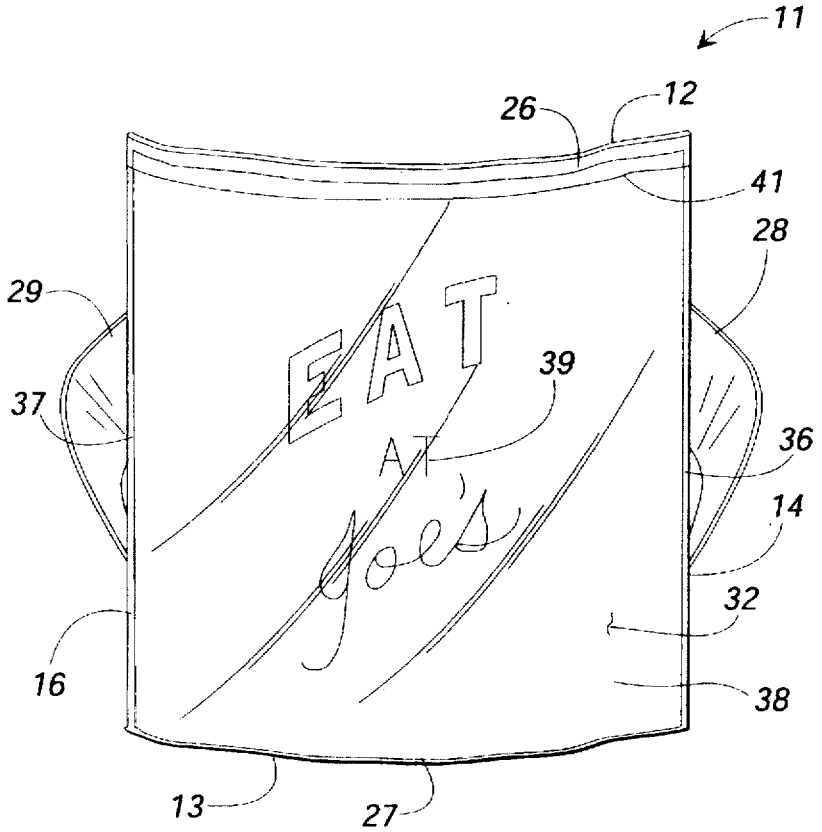
FIG. 2 is an elevational view of the back pack of this invention as seen from the rear while being worn on a wearer's back and showing a sample of promotional advertising that may be inserted into the back pocket.
Figure 3A:
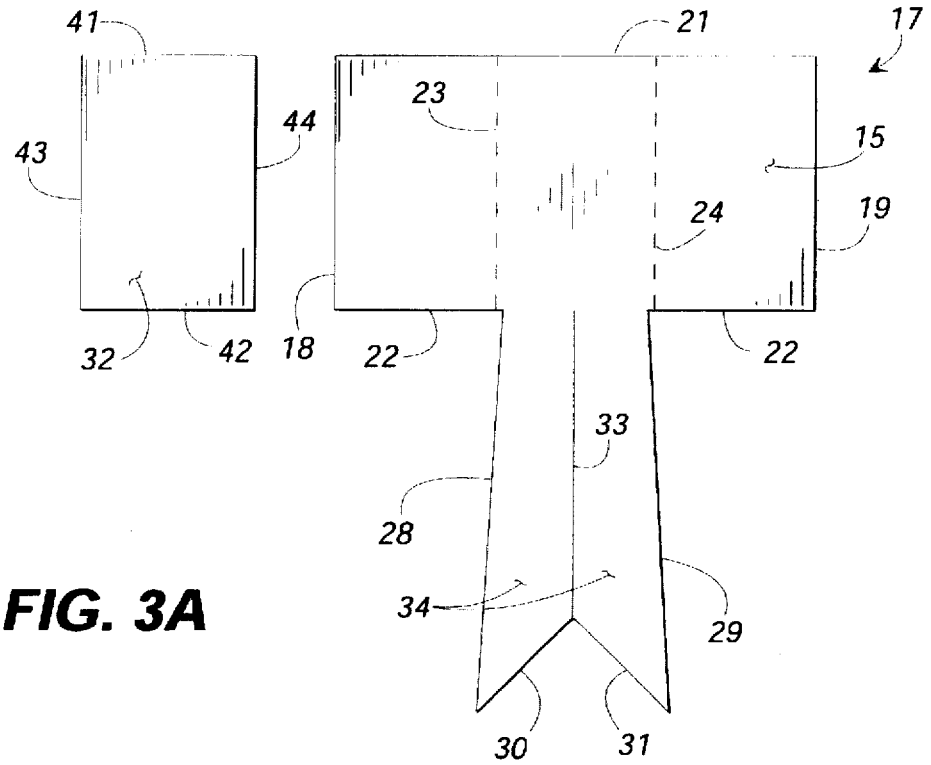
FIGS. 3A–3D illustrate one preferred method of fabricating the disposable back pack of the present invention.

Referring now in more detail to the drawings, in which like numerals refer to like parts throughout the several views, FIGS. 1 and 2 illustrate a disposable plastic back pack that embodies principles of the present invention in a preferred form. The back pack 11 is generally rectangular in nature and has a top 12, a bottom 13, and sides 14 and 16. As demonstrated through the sequence of FIGS. 3A–3D, the back pack 11 is formed from a sheet 17 of thin plastic film of the type commonly associated with disposable bags. As most clearly shown in FIG. 3A, the sheet 17 has a generally rectangular body portion 15 that has a top edge 21, a bottom edge 22, a first end 18 and a second end 19. The sheet 17 also has an elongated tail portion 34 extending from the bottom edge 22 of the body portion 15. The tail portion 34 extends in a direction generally perpendicular to the bottom edge 22 of the body portion 15, and has a centrally extending longitudinal slit 33 therethrough forming adjacent first and second tail sections 28 and 29, respectively.

The first tail section 28 has an angled distal end 30 and is a mirror image of the second tail section 29 which has an angled distal end 31. Each of the tail sections 28 and 29 is outwardly tapered from the body portion to its distal end and is wider at its end. As a result of this arrangement, the wider distal ends of each tail section 28 and 29 give the tail portion a V-shaped appearance when the tail sections are in contact along the longitudinal slit 33.

Fold lines 23 and 24 are depicted on body portion 15 and each fold line is spaced from and oriented parallel to one of the ends of the body portion 15.

The second sheet of plastics material 32, which forms the auxiliary pocket of the present invention, is a generally rectangular sheet 32 of thin plastic film of the type commonly associated with disposable bags. The second sheet 32 has a top edge 41, a bottom edge 42, and ends 43 and 44. Typically and preferably, the second sheet of plastics material 32 is transparent.

Figure 3B:
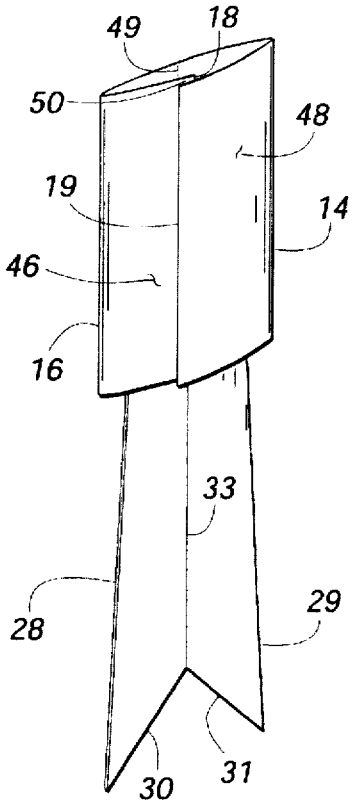

In forming the disposable back pack of the present invention, the body portion 15 is folded over onto itself along the first fold line 23 to form a first flap 46 and along the second fold line 24 to form a second flap 48, as best illustrated in FIG. 3B. The fold lines 23 and 24 are positioned such that when the body portion 15 is folded along these lines, the ends 18 and 19 of flaps 46 and 48 meet and, preferably, overlap at a line intermediate the fold lines illustrated by broken line 49 in FIG. 3B. When folded in this way, the top and bottom edges of the flaps align with the top and bottom edge of the central portion of the body 15.

Figure 3C:
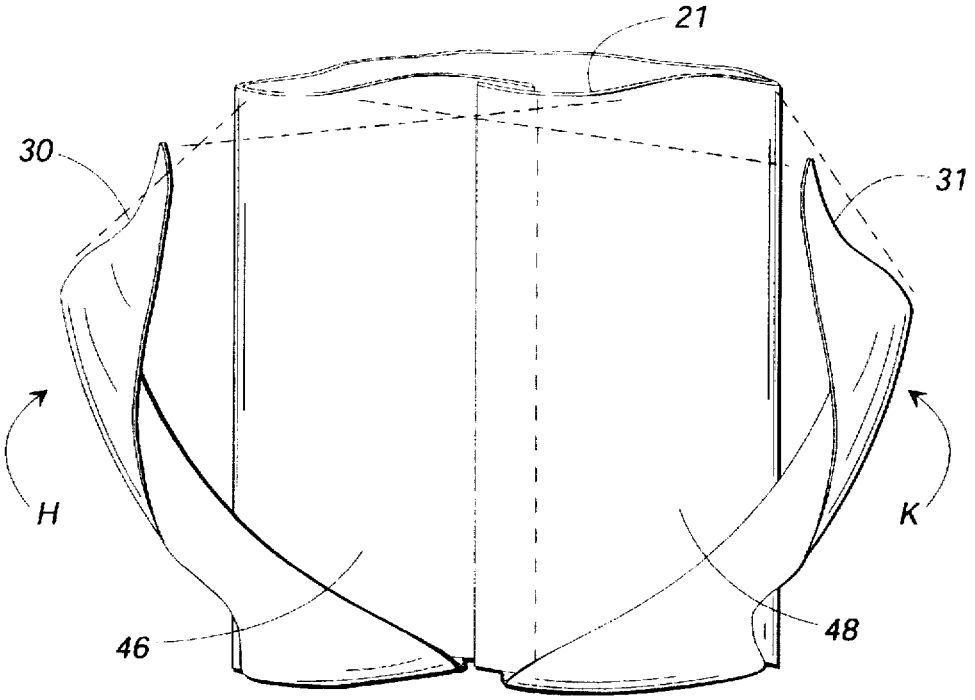

As illustrated in FIG. 3C, the tail sections 28 and 29 are folded over the flaps 46 and 48 and twisted inward a half turn toward the line intermediate the fold lines 23 and 24 as indicated by reformed arrows h and k. Because the distal ends 30 and 31 of the tail sections 28 and 29 are inwardly angled, the 180° inward rotation of the tail sections aligns the distal ends 30 and 31 of the tail sections 28 and 29 with the top edge of the flaps 46 and 48 as shown in FIG. 1.

Figure 3D:
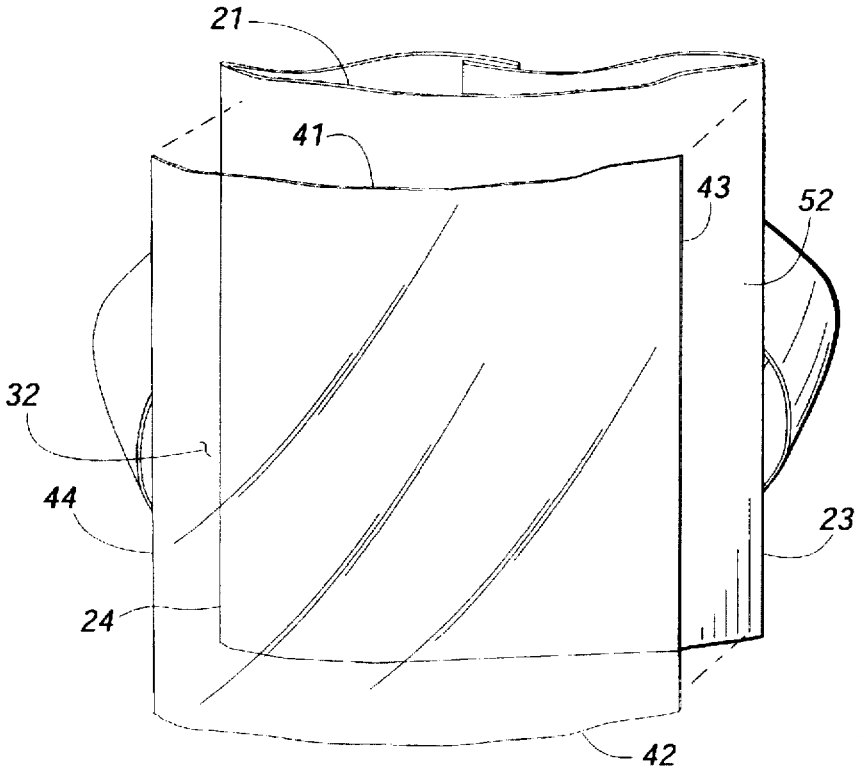

As shown in FIG. 3D, the second sheet 32 of plastics material is placed adjacent the side of the body portion 15 opposite the folded tail sections 28 and 29. This part of the body portion is known alternatively as the unfolded body portion 52. The second sheet 32 is positioned such that its bottom edge 42 is aligned with the bottom edge 22 of the unfolded body portion 52 and such that its ends 43 and 44 are substantially aligned with the fold lines 23 and 24. When aligned in this way, the top edge 41 of the second sheet 32 is offset from the top edge 21 of the unfolded body portion 52. With the edges and sides of the body portion and second sheet and the distal ends of the tail sections thus aligned, the resulting rectangular pouch is heat sealed along its top and bottom as indicated by numerals 26 and 27, and along the sides as indicated by numerals 36 and 37, as shown in FIG. 2. This functions to secure the folded and aligned sections together. The folded heat sealed sheet, thus assembled, forms a generally rectangular pouch 25 and the overlapping ends 18 and 19 define a slot 50 providing access to the interior of the pouch.

In addition, the tail sections 28 and 29 form the shoulder straps of the disposable back pack 11 of the present invention. When the wearer's arms are placed through the shoulder straps 28 and 29 of the back pack 11, the straps 28 and 29 comfortably conform to the wearer's body. This is due to the shape of the tail sections 28 and 29, the twisted configuration of the tail sections, and the angle formed on the distal ends of the tail sections. Moreover, the second sheet 32 of plastics material forms an upwardly open pocket 38 on the side of the pouch 25 opposite the shoulder straps 28 and 29. Because the second sheet 32 of plastics material is offset below the heat seal along the top edge 21 of the body portion 15, the pocket 38 remains open along the top edge 41 of the plastic sheet 32. The pocket 38 is therefore disposed for slidably receiving advertisement sheets and other promotional indicia 39, which are clearly visible through the plastics material.

The disposable plastic back pack 11 of the present invention can be produced extremely economically from materials that are disposable such as thin plastic sheets. These back packs can then be given away at conventions and tradeshows for use by the attendees at the shows. When at the shows, the attendees need only place collected materials 35 in the pouch 25 through the slot 50 provided by overlapping ends 18 and 19. Personal items can also be placed in the pocket 38. The back pack can then be donned by placing one's arms through the twisted straps 28 and 29 and wearing the back pack 11 on the back with the access slot 50 positioned against the back. In this way, the materials 35 within the back pack are protected and do not tend to fall out of the pouch 25.

As indicated in FIG. 2, the other side of the pouch 25, which is visible when the back pack 11 is worn, provides a pocket 38 in which promotional indicia 39 can be placed. Such indicia might include the name of a sponsor, the name of a food or soft drink company, or any other advertising that can be printed on a surface. As the back pack 11 of the present invention is worn at conventions and tradeshows, the advertisements printed thereon are easily visible at or just below eye level for all of the many attendees. In addition, when attendees leave the convention or show wearing the pack, the advertisement moves onto the streets and can be seen by common pedestrians. Finally, the usefulness of the back pack is not limited to containing items at a show. Accordingly, it is likely that patrons of the shows will keep the back packs and use them as a common back pack after the show is over rather than discarding them as they would a mere carrying bag. This enhances the effectiveness of any advertising on the back pack 11 since it is seen over and over again each time the pack is used.

It has been mentioned that the back pack 11 of the present invention is disposable. This is because it is formed inexpensively of a material that is itself inexpensive and ultimately discardable. Since the entire item is discardable, it is preferable that the plastics material chosen for its construction be biodegradable over time so that the discarded back packs do not clog land fills or otherwise adversely affect the environment. Instead, they simply deteriorate over time reincorporating into the earth from which they came.

The invention has been described herein in terms of preferred embodiments and methodology. It will be obvious to those of skill in the art, however, that various changes might be made to the illustrated embodiments within the scope of the invention. For example, the back pack could be formed of canvas or another more permanent material. Under these circumstances, the back pack would not be discardable but would be an item that could be used over and over for years. Moreover, the second sheet of plastics material could be opaque or otherwise non-transparent. In this way, advertisements could be preprinted on the second sheet 32. In addition, the preferred order in which the steps of the fabrication process are performed have been discussed. Obviously, however, these steps might be performed in a different order or in slightly different ways without detracting from the invention itself. These and other additions, deletions, and modifications might well be made to the illustrated embodiments without departing from the spirit and scope of the invention as set forth in the following claims.

I claim:

1. A disposable back pack adapted to be worn on the back of a wearer, said back pack comprising:

a sheet of plastics material, said sheet including a substantially rectangular body portion having a top edge, a bottom edge, a first end, and a second end, and an elongated tail portion extending from the bottom edge, said tail portion having a longitudinal slit extending therealong and forming adjacent first and second tail sections each having a distal end, said body portion being folded over onto itself along a first fold line spaced from said first end and along a second fold line spaced from said second end to form a folded body portion and an unfolded body portion, the first and second ends being adjacent to each other along a line intermediate said fold lines, said first and second sections of said tail portion being folded over said folded body portion and twisted inward a half turn toward said line intermediate said fold lines so that the distal ends of said first and second sections are substantially adjacent to and aligned with the top edge of the folded body portion, said folded body portion being sealed to itself along at least its top and bottom edges to form a pouch with the sealed together top and bottom edges forming the top and bottom of said pouch, the fold lines forming the sides of said pouch, and the adjacent first and second ends of the body portion forming an open slot extending between the top and bottom of said pouch for providing access thereto, and said distal ends of said first and second tail sections being sealed to the top edge of the folded body portion forming first and second shoulder straps for receiving the arms of the wearer to support said pouch on the wearer's back with said open slot positioned against the back.

2. A disposable back pack as claimed in claim 1 wherein said folded body portion is sealed to said unfolded body portion along the first and second fold lines.

3. A disposable back pack as claimed in claim 1 further comprising:

a second substantially rectangular sheet of plastics material having a top edge a bottom edge and ends and being sealed along its bottom edge to the bottom edge of said unfolded body portion and along its ends to the sides of said pouch.

4. A disposable back pack as claimed in claim 3 wherein said second rectangular sheet of plastics material is transparent.

5. A disposable back pack as claimed in claim 3 wherein said body portion, the distal ends of said first and second tail sections, and said second substantially rectangular sheet of plastics material are sealed simultaneously.

6. A disposable back pack as claimed in claim 1 wherein said plastics material is biodegradable.

7. A disposable back pack as claimed in claim 1 wherein said top and bottom edges, and the distal ends of said first and second sections of said tail portion are heat sealed.

8. A method of fabricating a disposable back pack adapted to be worn on the back of a wearer, said method comprising the steps of:

(a) providing a sheet of plastics material, said sheet including a body portion having a top edge, a bottom edge, a first end and a second end, and an elongated tail portion extending from the bottom edge of said body portion;

(b) dividing said tail portion into two adjacent sections, each section having a distal end;

(c) folding said body portion over onto itself along a first fold line spaced from the first end and folding said body portion over onto itself along a second fold line spaced from the first end to form a folded body portion and an unfolded body portion, the first and second ends being substantially adjacent to each other along a line intermediate said fold lines;

(d) folding said first and second sections of said tail portion over said folded body portion;

(e) twisting said first and second sections inward a half turn toward said line intermediate said fold lines so that the distal ends of said first and second sections are substantially adjacent to and aligned with the top edge of said folded body portion;

(f) sealing said folded body portion to said unfolded body portion along the top and bottom edges to form a pouch with the sealed together top and bottom edges of the body portion forming the top and bottom of the pouch, with the fold lines forming the sides of the pouch, and with the ends of the body portion forming a slot for access to the pouch; and (g) sealing the distal ends of said first and second tail sections to the top edge of said folded body portion to form first and second shoulder straps, whereby the pouch can be worn as a back pack on the back of the wearer so that the slot is positioned against the wearer's back.

9. The method of claim 8 further comprising the steps of:

(a) providing a second sheet of plastics material having a top edge, a bottom edge, and ends; and (b) sealing the bottom edge of said second sheet along the bottom edge of said unfolded body portion, and sealing the ends of the second sheet along the sides of the pouch to form an upwardly open pocket on a side of the pouch opposite said slot for receiving items therein.

10. The method of claim 9 further comprising the step of simultaneously heat sealing said body portion, the distal ends of said tail sections, and said second sheet of plastics material.

11. The method of claim 8 wherein in step (b) the body portion is folded so that its ends overlap to permit easy access to the pouch.

12. A disposable plastic back pack comprising a sheet of plastics material cut to define a body portion having opposed top and bottom edges and opposed end edges and a pair of elongated tail sections extending from said bottom edge to free ends, said body portion being folded onto itself, along a first fold line spaced from one of said end edges and along a second fold line spaced from the other one of said end edges, said fold lines being located so that said opposed ends of said body portion substantially meet along a line intermediate said fold lines, said tail sections being twisted through one-half revolution and folded over said body portion so that the free ends are aligned with said top edge of said body portion, said folded body portion and tail free ends being heat sealed together along said top and bottom edges to form a pouch and a pair of shoulder straps for wearing the pouch on the back.

13. The back pack of claim 12 and wherein said tail sections taper outwardly from said body portion to said free ends.

14. The back pack of claim 13 and wherein said free ends of said tail sections are cut at an inwardly extending angle to form straps that conform to a wearer's body.

* * * * *